US011719507B2

(12) United States Patent
Chia

(10) Patent No.: US 11,719,507 B2
(45) **Date of Patent: *Aug. 8, 2023**

(54) HIGH PERFORMANCE LAUNCHER OF SHORT PROJECTILES WITH STORAGE DRUM

(71) Applicant: EASEBON SERVICES LIMITED, Kwun Tong (HK)

(72) Inventor: Francis See Chong Chia, Kowloon (HK)

(73) Assignee: EASEBON SERVICES LIMITED, Kwun Tong (HK)

( * ) Notice: Subject to any disclaimer, the term of this patent is extended or adjusted under 35 U.S.C. 154(b) by 0 days.

This patent is subject to a terminal disclaimer.

(21) Appl. No.: 17/984,435

(22) Filed: Nov. 10, 2022

(65) Prior Publication Data

US 2023/0074440 A1 Mar. 9, 2023

Related U.S. Application Data

(63) Continuation of application No. 17/339,486, filed on Jun. 4, 2021, now Pat. No. 11,519,689.

(60) Provisional application No. 63/117,510, filed on Nov. 24, 2020.

(51) Int. Cl.
*F41B 11/89* (2013.01)
*F41B 11/646* (2013.01)
*F41B 11/54* (2013.01)

(52) U.S. Cl.
CPC ..... *F41B 11/646* (2013.01); *F41B 11/54* (2013.01); *F41B 11/89* (2013.01)

(58) Field of Classification Search
CPC ..... F41B 11/54; F41B 11/646; F41B 11/89; F41B 11/55
USPC ..... 124/48, 66, 67
See application file for complete search history.

(56) References Cited

U.S. PATENT DOCUMENTS 2,735,206 A * 2/1956 Butler et al. ..... F41A 9/65 42/50
2,830,570 A * 4/1958 Horowitz ..... F41B 7/006 124/52
4,756,297 A * 7/1988 Sindel ..... F41B 11/642 124/67
4,819,609 A * 4/1989 Tippmann ..... F41B 11/54 124/66
4,843,751 A * 7/1989 Ferri ..... F41B 11/55 124/67

(Continued)

*Primary Examiner* — Alexander R Niconovich
(74) *Attorney, Agent, or Firm* — Amster, Rothstein & Ebenstein LLP

(57) ABSTRACT

A toy projectile launcher having a projectile drum, a cocking slide, and a housing is disclosed. The projectile drum contains projectile holders that are adapted to hold a projectile, such as a foam dart. The cocking slide can be moved forward and backward. The housing houses a launch barrel and an air piston assembly. When the cocking slide is moved backward the air piston barrel moves backward, the launch barrel is moved forward away from a first projectile holder in the plurality to facilitate loading of a projectile into a holder. When the cocking slide is moved forward an air nozzle forms an airtight seal between the air piston barrel and the projectile holder, while the launch barrel is moved backward to form an airtight seal between the projectile holder and the launch barrel.

29 Claims, 6 Drawing Sheets

(56) References Cited

U.S. PATENT DOCUMENTS 4,850,328 A * 7/1989 Sindel ..... F41B 11/55 124/66
5,186,156 A * 2/1993 Clayton ..... F41B 11/55 124/66
5,522,374 A * 6/1996 Clayton ..... F41B 11/646 124/66
5,680,853 A * 10/1997 Clayton ..... F41B 11/55 124/66
6,220,237 B1 * 4/2001 Johnson ..... F41B 11/89 124/75
7,861,701 B1 * 1/2011 Wei ..... F41B 11/55 124/73
8,146,579 B2 * 4/2012 Jablonski ..... F41B 11/646 124/65
8,726,894 B2 * 5/2014 Carlson ..... F41B 11/723 124/66
9,032,945 B2 * 5/2015 Chia ..... F41B 11/89 124/66
9,134,091 B2 * 9/2015 Busse ..... F41B 11/642
9,239,206 B1 * 1/2016 Nguyen ..... F41B 11/646
9,347,735 B2 * 5/2016 Falkowski, II ..... F41B 7/003
9,389,042 B1 * 7/2016 Clayton ..... F41B 11/642
10,267,593 B2 * 4/2019 Lamboy ..... F41B 11/54
10,488,148 B2 * 11/2019 Johnson ..... F41B 11/89
10,648,764 B2 * 5/2020 Spielberger ..... F41B 7/006
10,859,337 B1 * 12/2020 Bernal ..... F41B 7/08
10,907,929 B2 * 2/2021 Bernal ..... F42B 6/00
11,226,168 B2 * 1/2022 Kowalczyk, Jr. ..... F41B 11/54
11,243,044 B2 * 2/2022 Chia ..... F41B 11/643
11,353,279 B2 * 6/2022 Chia ..... F41B 7/006
2010/0147277 A1 * 6/2010 Zimmerman ..... F41B 11/55 124/56
2012/0125304 A1 * 5/2012 Brooks ..... F41B 7/003 124/52
2019/0113303 A1 * 4/2019 Johnson ..... F41B 11/55

* cited by examiner

100

HIGH PERFORMANCE LAUNCHER OF SHORT PROJECTILES WITH STORAGE DRUM

REFERENCE TO OTHER APPLICATIONS

This application is a continuation of and claims the benefit of and priority to U.S. patent application Ser. No. 17/339,486, filed on Jun. 4, 2021 and entitled HIGH PERFORMANCE LAUNCHER OF SHORT PROJECTILES WITH STORAGE DRUM, which in turn claims the benefit of and priority to U.S. Provisional Patent Application No. 63/117,510, filed on Nov. 24, 2020, entitled "HIGH PERFORMANCE LAUNCHER OF SHORT PROJECTILES WITH STORAGE DRUM," the contents of which are incorporated by reference herein in their entirety.

FIELD

The present disclosure is generally related to a toy projectile launcher, such as a toy pistol, gun, and the like, for launching toy projectiles, such as foam bullets, darts, balls, and the like, with a simplified construction and improved performance.

BACKGROUND

Traditional toy projectile launchers have utilized various forms of rifles, pistols, blasters, machine guns, and the like, for launching toy projectiles, such as foam balls and darts, to name a few. Such toy launchers have varied in size, power, and storage capacity, to name a few. More specifically, toy launchers of foam projectiles—bullets (or "darts"), balls, and the like—have become ubiquitous. One standard for foam bullets has been marketed under the brand name Nerf® with a rubber tip and a foam body that totals approximately 71.5 mm in length. There have been various types of rifles, machine guns, and the like that have been marketed for launching such foam projectiles.

The caps of the toys darts are generally made of a material other than foam that allows the dart to be shot from the launcher at a targeted person or object and/or propelled over an appropriate distance and/or at a relatively quick speed.

Conventional dart guns have traditionally been marketed to pre-teen children for casual play. More recently, in conjunction with the advent of special event war games—such as paintball, laser tag, and the like—more high-powered launchers have been developed to target enthusiasts for such special events using foam darts.

As an example, launchers having metal barrels, instead of plastic ones, have been used for improved launching velocity. Such launchers and darts are usually dimensioned to have a very small clearance—between the inner diameter of the barrel of the launcher and the outer diameter of the dart—so as to provide improved launching speed and accuracy.

With the above-mentioned metal-barreled launchers, there is still a need to further improve the launching force of the projectiles.

SUMMARY

To address the above needs, the present disclosure is generally related to an improved toy launcher for launching high performance foam darts. According to an exemplary embodiment of the present disclosure, one or more sealing mechanisms are provided to improve air-tight seals from an air piston mechanism to a launch barrel of a toy projectile launcher. Advantageously, an effective and high-performance blaster may be realized that provides high velocity and accurate projectile launching.

Particularly, the present disclosure is directed to a toy launcher with a simple construction for an improved integrated launcher with a two-step loading/priming and firing mechanism that incorporates improved airtight seals among elements of the launcher for realizing high launching force for compact projectiles.

According to an exemplary embodiment, the toy launcher includes a projectile holder, a launch barrel, an air piston assembly, and a cocking slide, wherein at least the projectile holder and the air piston assembly are coupled to the cocking slide.

According to an exemplary embodiment, the air piston assembly includes an air piston barrel, a plunger element, and a compression spring.

In embodiments, the toy launcher includes a coupling between the cocking slide and the air piston barrel.

In embodiments, the air piston barrel is movable to a backward position when the cocking slide is moved to the backward position.

In embodiments, a front portion of the air piston barrel pushes the plunger element to compress the compression spring against the rear wall of the toy launcher when the cocking slide is moved to the backward position.

In embodiments, the launch barrel is coupled to the cocking slide, wherein the launch barrel is moved forward away from a front portion of the projectile holder when the cocking slide is moved to the backward position.

In embodiments, the toy launcher further includes a launch barrel extender assembly that is coupled to the cocking slide, wherein the launch barrel extender assembly is moved forward away from a front portion of the projectile holder when the cocking slide is moved to the backward position.

In embodiments, the projectile holder includes a projectile advancement mechanism for advancing a next loaded projectile in the projectile holder into a priming position in front of the air piston barrel.

In embodiments, the plunger element and the air piston barrel form an internal air chamber when the cocking slide is moved from the backward position to the forward position.

In embodiments, a front portion of the air piston barrel includes an air nozzle, wherein the air nozzle is moved forward to form an airtight seal between the air piston barrel and a rear portion of the projectile holder when the cocking slide is moved from the backward position to the forward position.

In embodiments, the launch barrel is coupled to the cocking slide, wherein the launch barrel is moved rearward towards the projectile holder to form an airtight seal between a rear portion of the launch barrel and the front portion of the projectile holder when the cocking slide is moved from the backward position to the forward position.

In embodiments, the toy launcher further includes a launch barrel extender assembly that is coupled to the cocking slide, wherein the launch barrel extender assembly is moved rearward towards the projectile holder to form an airtight connection between a front portion of the projectile holder and a rear portion of the launch barrel when the cocking slide is moved from the backward position to the forward position.

In embodiments, the plunger element is pushed forward by the compression spring to expel the air from the internal air chamber through the air nozzle on the front portion of the air piston barrel behind the loaded projectile in the firing position when the coupling of the latching assembly between the plunger element and the trigger assembly is released.

In embodiments, in the firing position, the air nozzle on the front end of the air piston barrel is immediately adjacent the projectile.

In embodiments, a toy projectile launcher comprises a projectile drum containing a plurality of projectile holders, each projectile holder adapted to hold one projectile; a cocking slide that is adapted to be moved forward and backward; and a housing, the housing having disposed therein: a launch barrel; an air piston assembly, the air piston assembly including an air piston barrel having an air nozzle disposed on a front portion thereof, a plunger element, and a compression spring; wherein the projectile drum, the launch barrel, and the air piston assembly are each coupled to the cocking slide; wherein, when the cocking slide is moved backward from a forward position to a backward position: the air piston barrel moves backward and pushes the plunger element to compress the compression spring against a rear wall of the housing, the launch barrel is moved forward away from a front portion of one of a first projectile holder in the plurality of projectile holders; and wherein, when the cocking slide is moved forward from the backward position to the forward position: the air nozzle moves forward to form an airtight seal between the air piston barrel and a rear portion of the first projectile holder; and the launch barrel is moved backward toward the front portion of the first projectile holder to form an airtight seal between the front portion of the first projectile holder and a rear portion of the launch barrel.

In embodiments, the air piston assembly is coupled to the cocking slide via a coupling between the air piston barrel and the cocking slide.

In embodiments, a tube holder is fixed to and surrounds at least a portion of the launch barrel, wherein the launch barrel is moved when a reciprocating frame coupled to the cocking slide slides against a lever coupled to the tube holder.

In embodiments, the projectile drum includes a projectile advancement mechanism for advancing a next projectile loaded into one of the plurality of projectile holders contained in the projectile drum into a firing position in front of the air piston barrel.

In embodiments, the plunger element and the air piston barrel form an internal air chamber when the cocking slide is moved from the backward position to the forward position.

In embodiments, the toy projectile launcher further comprising a latching assembly coupled between the plunger element and a trigger assembly, wherein the trigger assembly is adapted to be pulled backward by a user of the toy projectile launcher.

In embodiments, when the trigger assembly is pulled backward, the coupling of the latching assembly between the plunger element and trigger assembly is released, and the plunger element is pushed forward by the compression spring to expel air from the internal air chamber through the air nozzle disposed on the front portion of the air piston barrel behind the loaded projectile in the firing position.

In embodiments, when the loaded projectile is in the firing position, the air nozzle disposed on the front portion of the air piston barrel is immediately adjacent to the loaded projectile.

In embodiments, the plunger element forms an airtight seal with an internal surface of the air piston barrel.

In embodiments, the first projectile holder contained in the projectile drum has a front opening, a main central portion, a rear end ring, and a rear opening, wherein the rear opening has a larger cross-sectional diameter than the main portion for accommodating the air nozzle, the rear opening and air nozzle forming an airtight seal from the air piston barrel to a rear end of a projectile loaded into the first projectile holder.

In embodiments, the air nozzle has an outer circumference having a first O-ring incorporated thereon, and wherein the first O-ring forms an airtight seal with an internal circumference of the rear opening of the first projectile holder.

In embodiments, the front opening of the first projectile holder has a larger cross-sectional diameter than the main central portion for accommodating the launch barrel, the front opening and launch barrel forming an airtight seal from the main central portion to the launch barrel.

In embodiments, a rear end of the launch barrel has a second O-ring incorporated thereon, and wherein the second O-ring and front opening of the projectile holder forms an air-tight seal between the launch barrel and the main central portion of the projectile holder.

In embodiments, the launch barrel sealing extender assembly has incorporated on an outer rear portion thereof a third O-ring, the third O-ring forming an airtight seal between the launch barrel and the first projectile holder.

In embodiments, the projectiles are foam darts.

In embodiments, a toy projectile launcher comprises a projectile drum containing a plurality of projectile holders, each projectile holder adapted to hold one projectile; a cocking slide that is adapted to be moved forward and backward; and a housing, the housing having disposed therein: a fixed launch barrel; a slidable launch barrel sealing extender assembly fitted over a rear end of the fixed launch barrel; an air piston assembly, the air piston assembly including an air piston barrel having an air nozzle disposed on a front portion thereof, a plunger element, and a compression spring; wherein the projectile drum, the slidable launch barrel sealing extender assembly, and the air piston assembly are each coupled to the cocking slide; wherein, when the cocking slide is moved backward from a forward position to a back-ward position: the air piston barrel moves backward and pushes the plunger element to compress the compression spring against a rear wall of the housing, the slidable launch barrel sealing extender assembly is moved forward away from a front portion of a first projectile holder in the plurality of projectile holders; and wherein, when the cocking slide is moved forward from the backward position to the forward position: the air nozzle moves forward to form an airtight seal between the air piston barrel and a rear portion of the first projectile holder; and the slidable launch barrel sealing extender assembly is moved rearward towards the first projectile holder to form an airtight connection between the front portion of the first projectile holder and the rear portion of the fixed launch barrel.

In embodiments, the first projectile holder contained in the projectile drum has a front opening, a main central portion, a rear end ring, and a rear opening, wherein the rear opening has a larger cross-sectional diameter than the main portion for accommodating the air nozzle, the rear opening and air nozzle forming an airtight seal from the air piston barrel to a rear end of a projectile loaded into the first projectile holder.

In embodiments, the air nozzle has an outer circumference having a first O-ring incorporated thereon, and wherein the first O-ring forms an airtight seal with an internal circumference of the rear opening of the first projectile holder, the front opening of the first projectile holder is adapted to accommodate the slidable launch barrel sealing extender assembly, the front opening and slidable launch barrel sealing extender assembly forming an airtight seal from the main central portion to the fixed launch barrel.

In embodiments, a rear end of the fixed launch barrel has a second O-ring incorporated thereon, and wherein a rear portion of the slidable launch barrel sealing extender assembly has a third O-ring incorporated thereon, the second O-ring and the third O-ring forming an airtight seal between the fixed launch barrel and the first projectile holder.

BRIEF DESCRIPTION OF THE DRAWINGS

Exemplary embodiments of the present disclosure will be described with references to the accompanying figures, wherein.

DETAILED DESCRIPTION

The present disclosure is generally related to an improved toy launcher with an assembly for sealing a launch barrel to thereby improve the air pressure launch force. To achieve this objective, according to an exemplary embodiment, a toy launcher incorporates internal sealing assemblies for improving airway seals between an air piston assembly and a launch barrel.

Figure 1:
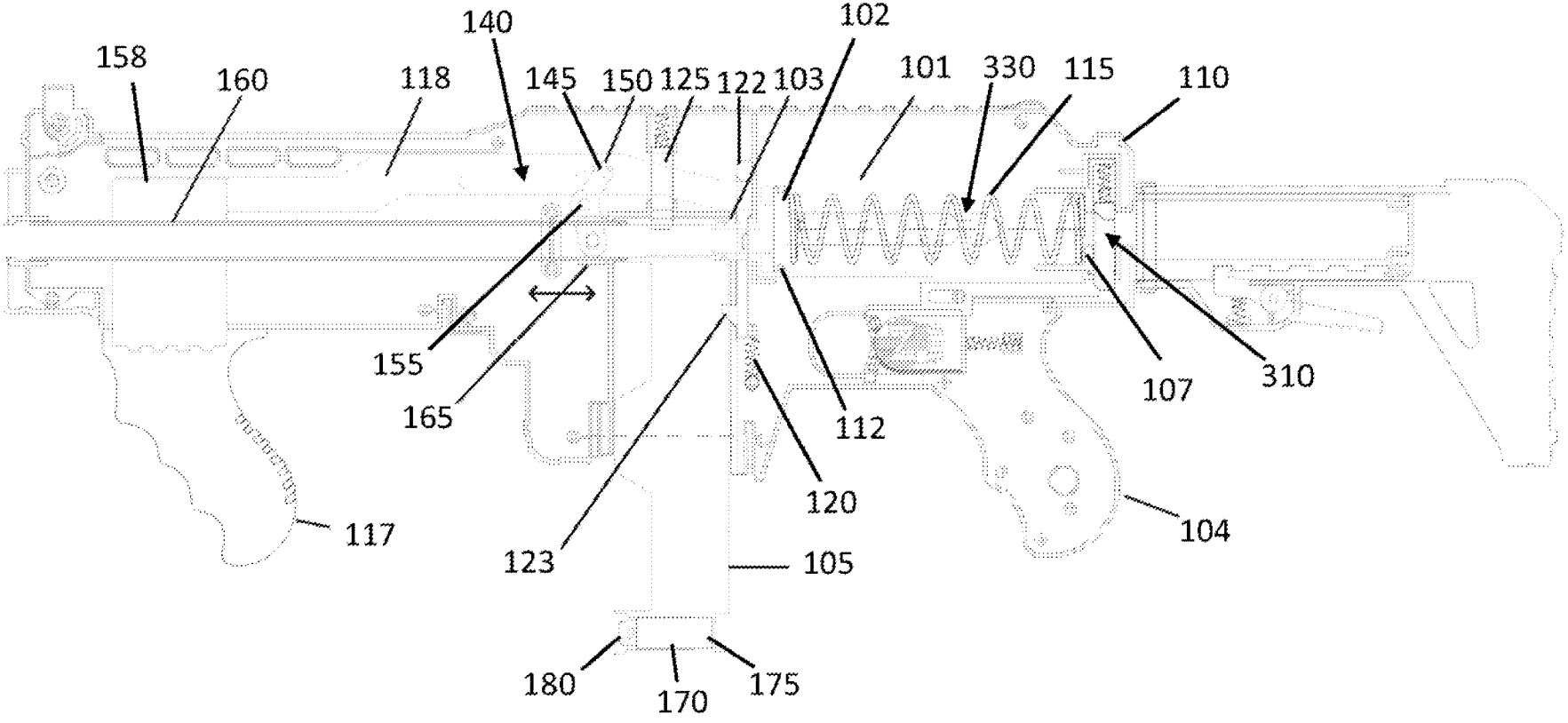
FIG. 1 is a schematic partial cross-sectional side view of key elements of a toy projectile launcher according to an exemplary embodiment of the present disclosure.

FIG. 1 is schematic partial cross-sectional views of key elements of a toy projectile launcher 100 according to an exemplary embodiment of the present disclosure. For clarity and simplicity in illustrating the key elements and mechanisms of toy projectile launcher 100, portions that are not necessary to understand the scope and the spirit of the present disclosure are not shown. One of ordinary skill in the art would readily understand the supporting elements needed to house and support the various illustrated elements, including those that facilitate the insertion and removal of drum 105 into and out of launcher 100, with various design choices that would not depart from the spirit and scope of the present disclosure.

FIG. 1 is a schematic side cross-sectional view of a projectile launcher 100 in an un-cocked position according to an exemplary embodiment of the present disclosure. As shown in FIG. 1, projectile launcher 100 is shaped to resemble a Thompson submachine gun (or "Tommy gun"). In embodiments, launcher 100 may be in various other shapes and arrangements without departing from the spirit and the scope of the disclosure, as detailed below. As illustrated in FIG. 1, a reciprocating air piston assembly comprised of a barrel 101, a plunger element 102, and a front air nozzle 103 is located above a handle 104 and disposed within a housing 110 of the projectile launcher 100 behind a projectile holding drum 105. According to an exemplary embodiment, barrel 101 of the air piston assembly has a generally rounded cylindrical or oval shape and plunger element 102 is biased against a back wall 107 of the rear part of launcher housing 110 by a compression spring 115. The plunger element 102 incorporates a size and a shape that correspond with an internal circumference of barrel 101 so as to form an airtight seal with an internal surface of barrel 101. According to an exemplary embodiment of the present disclosure, plunger element 102 incorporates a resilient O-ring 112 (made from a resilient material, such as a polymer) to form an improved seal. As shown in FIG. 1, barrel 101 is coupled to a cocking slide (front handle) 117 via a reciprocating frame 118 that is fittingly coupled to, along with cocking slide 117, a track (not shown) incorporated in the housing 110 of launcher 100. As will be described in further detail below, reciprocating frame 118 moves back and forth when cocking slide 117 is cocked back and forth in a manner similar to a pump action shotgun, which, in turn, primes the air piston assembly while feeding a foam dart for launch.

As shown in FIG. 1, an extension spring 120 is coupled to a drum advancement block/plate 122 that includes a hook element 123 for engaging a corresponding notch (not shown) on drum 105. As will be described in further detail below, drum 105 for holding projectiles—such as foam darts/bullets and the like—would be advanced by block 122 such that a next projectile would be delivered to a firing position. Correspondingly, a spring-loaded stopper block 125 is incorporated in the top portion of housing 110 for holding drum 105 into an aligned position when drum 105 is advanced via block 122 and hook element 123.

In embodiments, drum 105 may be non-removable from launcher 100. Having a drum 105 as a separable component may be desirable for purposes such as for compact packaging and shipping of launcher 100, or replacing drum 105 as needed or desired (e.g., if drum 105 is broken or to be used for launching a different type of projectile) or to enable a user to carry a second loaded drum to increase the user's firepower. In alternative embodiments, a retractable rod (not shown) may be used in place of openings on the bottom of launcher 100 to allow drum 105 to be loaded into launcher 100. Once drum 105 is loaded into launcher 100, the rod may be returned to a closed position to retain drum 105. In embodiments, the rod may be secured in a closed position with a releasable lock or latch so that drum 105 is not accidentally released from launcher 100. The rod may be retracted from the center of drum 105 to allow drum 105 to be removed. In embodiments, a release button (not shown) or the like may be incorporated in launcher 100 to release the lock or latch. In embodiments, drum 105 may incorporate attachment elements (not shown) for detachably engaging corresponding elements (not shown) in launcher 100 for a rotatable joint that allows for rotating advancement by block 122 and hook element 123, with stopper block 125 ensuring an aligned unitary advancement of drum 105 upon each pull on handle 117 by a user.

In the illustrated embodiment, drum 105 is configured to shoot toy darts. Darts may be loaded into drum 105 before drum 105 is loaded into launcher 100 and/or darts may be loaded and/or refilled in drum 105 after drum 105 is loaded into launcher 100.

Referring back to FIG. 1, reciprocating frame 118 incorporates a track 140 for slidably engaging a corresponding pin 145 of a pivotable barrel-moving lever 150 so that reciprocating frame 118 can slide along track 140 against lever 150 when reciprocating frame 118 is moved back and forth by a user moving cocking slide 117 back and forth. According to an exemplary embodiment, lever 150 is anchored to housing 110 of launcher 100 with a pin 155 to allow lever 150 to pivot around pin 155 as track 140 slides against pin 145, as will be described in further detail below. In embodiments, reciprocating frame 118 and/or lever 150 may be disposed on one side of or between two side portions of one or the other. The front portion of reciprocating frame 118 is coupled to a block/frame 158 that is, in turn, coupled to cocking slide handle 117 around launch barrel 160, as shown in FIG. 1.

Lever 150 may, therefore, extend to the left side and/or the right side of reciprocating frame 118 for a coupling(s) to pin 145, which extends through the two sides of track 140. As illustrated in FIG. 1, lever 150 is also coupled to launch barrel 160 via a tube holder 165. In embodiments, tube holder 165 is fixed to and surrounds at least a portion of launch barrel 160. As will be described in further detail below, lever 150 is coupled to tube holder 165 via a pivotable fastener 335 (see FIGS. 3A and 3B) and, thereby, allows a user to pull back cocking slide 117 in order to move launch barrel 160 forward, while moving the air piston assembly—i.e., barrel 101 and plunger element 102—backward and advancing drum 105 in a first, pull-back, priming step.

Figures 2A, 2B:
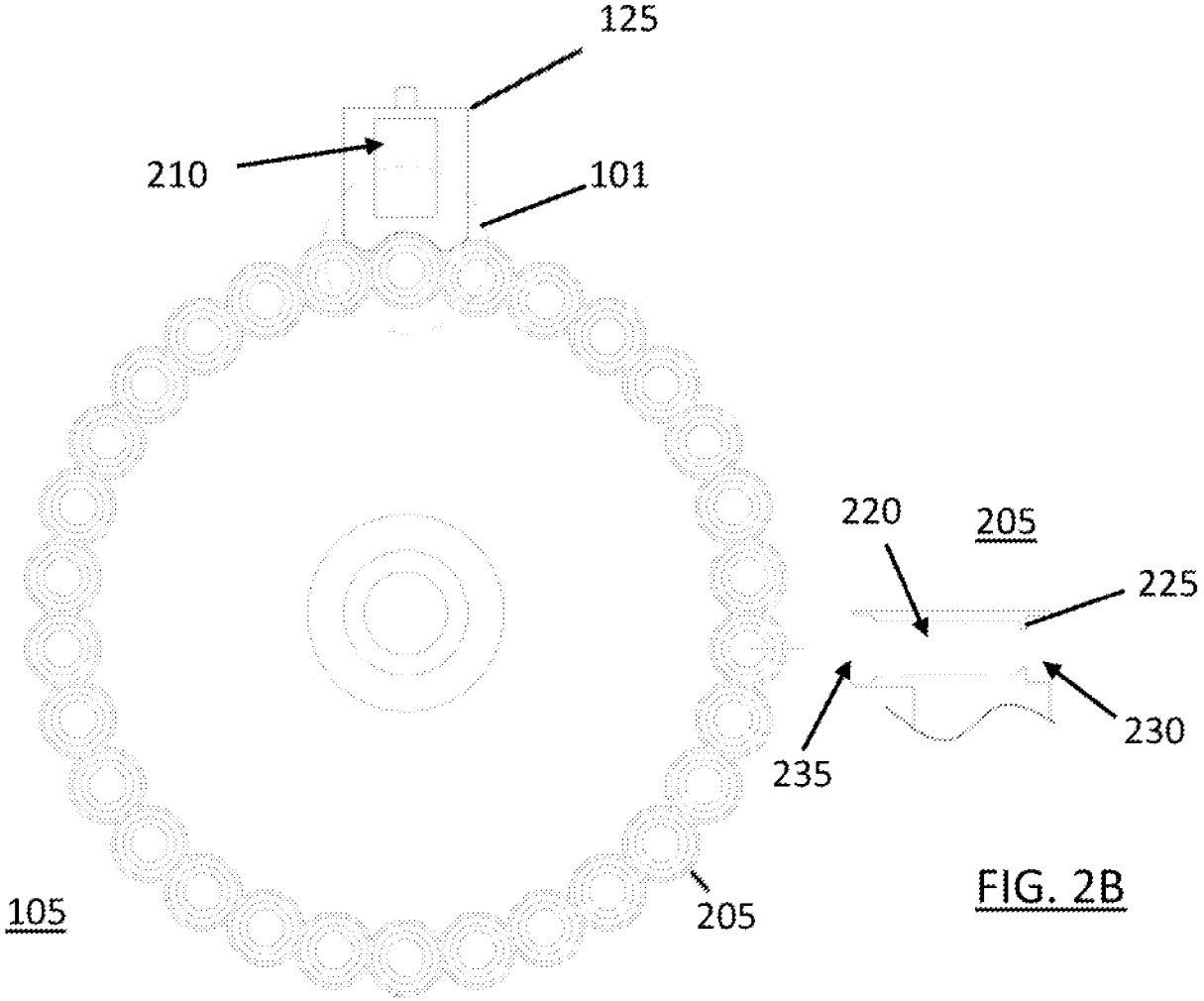
FIG. 2A is a front view of a feed drum shown in FIG. 1 according to an exemplary embodiment of the present disclosure.
FIG. 2B is an inset cross-sectional side view of one dart-holding chamber of the drum shown in FIG. 2A according to an exemplary embodiment of the present disclosure.

FIG. 2A is a schematic front view of drum 105 shown in FIG. 1 according to an exemplary embodiment of the present invention. As shown in FIG. 2A, drum 105 includes thirty (30) integrated dart holders 205 around its outer circumference, each dimensioned to accommodate a foam dart 170 (see FIG. 1) for use with launcher 105. As further illustrated in FIG. 2A, launcher 100 incorporates a spring-loaded stopper block 125 that exerts a downward force on drum 105 with a lower edge that is shaped to hold a dart holder 205—and, thus, drum 105—in alignment. Spring-loaded stopper block 125 incorporates an aperture 210 to provide clearance for reciprocating frame 118 to extend from a front portion to a rear portion of launcher 100, as illustrated in FIG. 1. As will be described below, the outer surface of drum 105 pushes upward to lift block 125 when user cocks slide handle 117 and advances drum 105.

FIG. 2B is a cross-sectional view of an individual dart holder 205 on the outer circumference of drum 105 for holding dart 170, which as shown in FIG. 1 has an elongate dart body 175 and a cap 180 that is affixed to the dart body. Dart body 175 has a substantially cylindrical shape and comprises a foam material, or the like, and cap 180 comprises a rubber material, or the like. In embodiments, dart 170 may have a total length, e.g., within a range of approximately 33 mm to 45 mm, such as 35 mm, 36 mm, 37 mm, or 40 mm, to name a few. Correspondingly, dart 170 has an outer cross-sectional diameter at its widest point of 12.9 mm. In alternative embodiments, dart 170 may have an outer cross-sectional diameter at its widest point of, for example, 12.5 mm, 13 mm, 14 mm, or 15 mm, to name a few. In embodiments, dart 170 may incorporate one or more recesses and corresponding ridges on its foam body—for example, as disclosed in U.S. patent application Ser. No. 16/895,172 filed on Jun. 8, 2020, the entire contents of which are incorporated by reference herein. As illustrated in FIG. 2B, each dart holder 205 includes a main central portion 220, which is formed in the shape of a cylinder with a cross-sectional diameter of about 13 mm for fitting and holding the widest point(s) of the foam body of dart 170. As further illustrated in FIG. 2B, each holder 205 includes a rear end ring 225 that extends inward to form an opening that is smaller in diameter than the main central portion 220. Ring 225 serves to abut the rear end of each dart 170 that is loaded into drum 105 by insertion though a front end 235, as well as to abut the front end of nozzle 103, as illustrated in FIG. 1. According to an exemplary embodiment of the present disclosure, the opening formed by rear end ring 225 has a diameter of about 9 mm for allowing compressed air from nozzle 103 to pass through to dart 170 to be launched. As shown in FIG. 2B, a rear opening 230 extending in the rearward direction from ring 225 has a larger cross-sectional diameter than main portion 220 for accommodating nozzle 103 to form an airtight seal from air piston barrel 101 to the rear end of dart 170. Correspondingly, front opening 235 extending from the front of main central portion 220 also has a larger cross-sectional diameter than main portion 220 in order to accommodate launch barrel 160 and to form an airtight seal from main portion 220 to launch barrel 160. According to an exemplary embodiment, launch barrel 160 has an inner diameter of approximately 13.26 mm to provide minimal clearance for dart 170, which each has an outer diameter of approximately 13 mm. Accordingly, front opening 235 is dimensioned to accommodate launch barrel 160 having the slightly enlarged inner diameter in comparison to the inner diameter of main portion 220 for a fitted hold of dart 170. According to an exemplary embodiment, front opening 235 has an inner diameter of about 16.2 mm and rear opening 230 has an inner diameter of about 14.8 mm. Main portion 220 has an interior diameter of about 12.9 mm and may be tapered slightly from ring 225 to front end 235—in other words, having a slightly larger interior circumference towards front end 235—to allow for inserting each dart 170 from front end 235 to abut ring 225 and for holding each dart 170 in place. As an example, the interior diameter of main portion 220 near front end 235 is slightly more than 12.9 mm and the interior diameter of main portion 220 near ring 225 is slightly less than 12.9 mm.

Figures 3A, 3B, 3C:
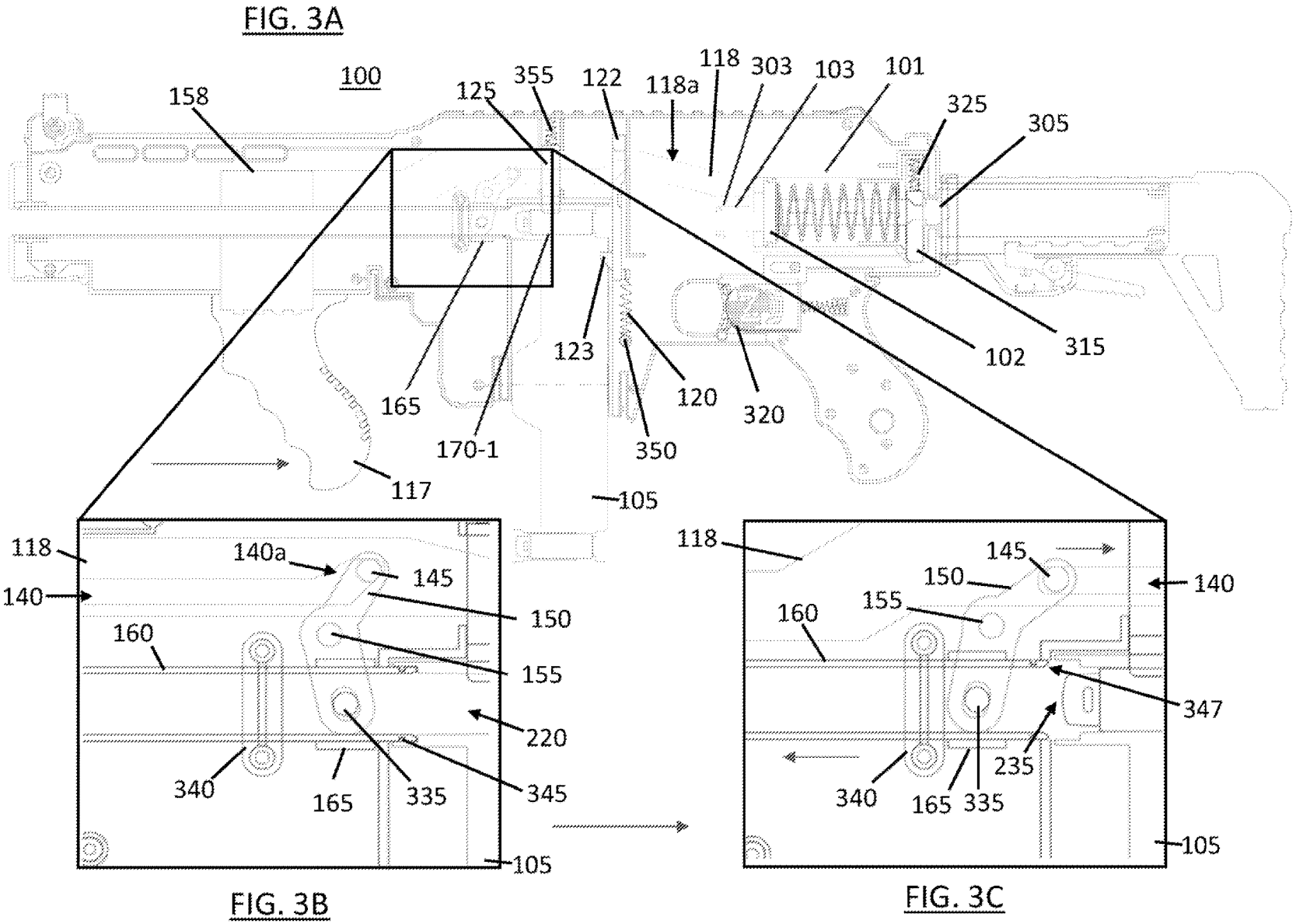
FIG. 3A is a schematic partial cross-sectional side view of the toy projectile launcher of FIG. 1 with a cocking slide or handle being placed in a rearward loading and priming (cocked) position according to an exemplary embodiment of the present disclosure.
FIGS. 3B and 3C are inset closeup cross-sectional side views illustrating details of a launch barrel moving assembly in the toy launcher of FIGS. 1 and 3A according to an exemplary embodiment of the present disclosure.

FIG. 3A is a schematic partial cross-sectional side view of the toy projectile launcher of FIG. 1 with a handle being placed in a rearward loading and priming (cocked) position according to an exemplary embodiment of the present disclosure. FIGS. 3B and 3C are inset closeup cross-sectional side views illustrating details of a launch barrel moving assembly in the toy launcher of FIGS. 1 and 3A according to an exemplary embodiment of the present disclosure.

As shown in FIG. 3A, toy launcher 100 includes barrel 101 with a plunger element 102 that forms an air piston assembly. As illustrated in FIG. 3A, barrel 101 is coupled to a sliding handle or cocking slide 117 via reciprocating frame 118 that is coupled to block/frame 158. The coupling between cocking slide 117 and frame 118 via block/frame 158 allows a user to pull back barrel 101 and plunger element 102 in a first, pull-back, priming step. As shown in FIG. 3A, spring 115 is compressed between plunger element 102 and back wall 107. Advantageously, plunger element 102 starts at a position near a front portion of barrel 101, as shown in FIG. 1, and, therefore, compression spring 115 may be fully compressed in the position illustrated in FIG. 3A.

According to an exemplary embodiment of the present disclosure, back wall 107 includes an aperture that allows a dome-shaped rod portion 305 to extend through and past another aperture 310 (see FIG. 1) that is incorporated in a spring-loaded plate 315 that is, in turn, coupled to a trigger assembly 320. When a user pulls cocking slide 117 backward in a fashion similar to a pump action rifle (see rearward arrow adjacent cocking slide 117 in FIG. 3A), block/frame 158 pushes on frame 118 so that barrel 101, plunger 102, and rod portion 305 are pushed back as well. Plate 315 is coupled to a compression spring 325 that biases plate 315 downward towards a trigger assembly 320. According to an exemplary embodiment of the disclosure, the leading edge of dome-shaped rod portion 305 is rounded and when it is pushed backward, the rounded leading sloped edge pushes upward on a top edge of aperture 310 (see FIG. 1) in plate 315, compressing spring 325, so that rod portion 305 can be pushed through aperture 310 from the front of plate 315 to clear an opposing back side of plate 315, as illustrated in FIGS. 1 and 3A. Once rod portion 305 is pushed sufficiently past plate 315 through aperture 310, spring 325 moves plate 315 downward into engagement with a notch or recess 330 (see FIG. 1) opposite the rounded face of rod portion 305 so that rod portion 305—and, correspondingly, plunger element 102—is engaged with, and temporarily retained in place by plate 315. As shown in FIG. 3A, the notch 330 hooks to the opposing back side of plate 315 above aperture 310 once plate 315 is pushed downwardly by compression spring 325 into notch 330 and, accordingly, a top edge of aperture 310 is pushed into a bottom surface of notch 330 (see FIGS. 1 and 3A)—thus, plate 315, compression spring 325, and notch 330 together form a latching assembly for holding rod portion 305 in the backward position.

As further shown in FIG. 3A and described above, with plunger element 102 and rod portion 305 pushed back by frame 118, spring 115 is compressed against the back wall 107 of main launcher housing 110 in the position at which plate 315 and notch 330 are hooked and engaged with each other. In alternative embodiments, a structural stop (not shown) may be used to limit the backward motion of cocking slide 117 to the above full extension position—i.e., the engagement position between notch 330 and plate 315.

Correspondingly, with barrel 101 and cocking slide 117 moved back to the configuration shown in FIG. 3A, nozzle 103 is pulled back away from the rear opening 230 of one of the dart holders 205 in drum 105, thus clearing the way on the rear end for drum 105 to rotate. On the front end, movement of launch barrel 160 will now be described with reference to FIGS. 1, 3B, and 3C. FIG. 3B is a closeup cross-sectional side view illustrating details of the assembly for moving launch barrel 160 in the resting position shown in FIG. 1. Specifically, with cocking slide 117 in the forward position shown in FIG. 1, pin 145 of lever 150 abuts a rear end of track 140 in reciprocating frame 118. As detailed in FIG. 3B, track 140 includes an upward sloping section 140*a* towards its rear end so that pin 145 is in an upward position when cocking slide 117—and, correspondingly, reciprocating frame 118—is in the forward position. Thus, tube holder 165 is in a rearward position, as shown in FIGS. 1 and 3B, and launch barrel 160 is inserted into front opening 235 of one of the dart holders 205 in drum 105.

Referring to FIG. 3C, as a user pulls back on cocking slide 117, pin 145 is moved downward along the rear section 140*a* of track 140, which, in turn, rotates lever 150 around pivot point 155 in a counterclockwise direction in the configuration shown in the figures. As a result, the rotation of lever 150 pulls tube holder 165 forward and thereby moves launch barrel 160 forward (see forward arrow adjacent launch barrel 160 in FIG. 3C). In embodiments, lever 150 may be rotated further by the front end of track 140 pushing pin 145 rearward with the rearward movement of reciprocating frame 118 (see rearward arrow adjacent pin 145 in FIG. 3C). Accordingly, the rear end of launch barrel 160 is withdrawn from front opening 235 (see FIG. 2B) of one of the dart holders 205 in drum 105, thus clearing the way on the front end for drum 105 to rotate. In embodiments, lever 150 may be coupled to tube holder 165 via one or more rotatable joints 335 on either or both sides of launch barrel 160. As illustrated in further detail in FIGS. 3B-3C, launcher 100 incorporates a stabilizing frame 340 that is fixed to housing 110 for keeping launch barrel 160 in alignment as it is slid back and forth by lever 150. In embodiments, the rear end of launch barrel 160 may incorporate a resilient O-ring 345 (see FIG. 3B) to further improve the airtight seal between launch barrel 160 and main central portion 220 of a dart holder 205 when the rear end of launch barrel is inserted into the front opening 235 of the dart holder 205. Additionally, according to an exemplary embodiment, the rear trailing interior edge of launch barrel 160 incorporates a rounded taper 347 around the interior circumference of launch barrel 160, as illustrated in FIG. 3C, to provide additional clearance for launching darts 170 and to avoid possible obstructions to such launchings by a cornered edge at the joint between main section 220 of drum 105 and launch barrel 160 in the launch configuration shown in FIG. 4 (i.e., with launch barrel 160 in the rearward position as also illustrated in FIG. 3B).

In substantial synchronization with nozzle 103 being retracted from rear opening 230 and launch barrel 160 being retracted from front opening 235, drum 105 is rotated to advance to a next dart holder 205. Referring back to FIGS. 1 and 3A, reciprocating frame 118 extends through an aperture in block 122 from the front portion to the rear portion of launcher 100 and a rear portion of reciprocating frame 118 includes an upward sloping surface 118*a* that pushes upward on a top edge of the aperture in block/plate 122 when reciprocating frame is pulled backward from the configuration shown in FIG. 1 to the configuration shown in FIG. 3A. As a result, extension spring 120 is extended from an anchor 350 that is fixed to housing 110 as block 122 and its hook element 123 are moved upward. As described above, hook element 123 engages a corresponding notch (not shown) on a rear surface of drum 105, either on the left side or the right side, in order to move and rotate drum 105—in either a clockwise or counterclock-wise direction in the configuration shown in FIG. 2A. In embodiments, drum 105 incorporates a ring of notches (not shown) on the rear surface thereof in alignment for engagement with hook element 123. As further described above, the outer surface of drum 105 pushes upward on block 125 as it is being advanced by hook element 123 until a next dart holder 205 becomes in substantial alignment with block 125, whereupon compression spring 355 pushes block 125 downward to fit around an outer surface of the next dart holder 205 (holding a next dart 170-1 shown in FIG. 3A) for alignment (such alignment being illustrated in FIG. 2A).

Figure 4:
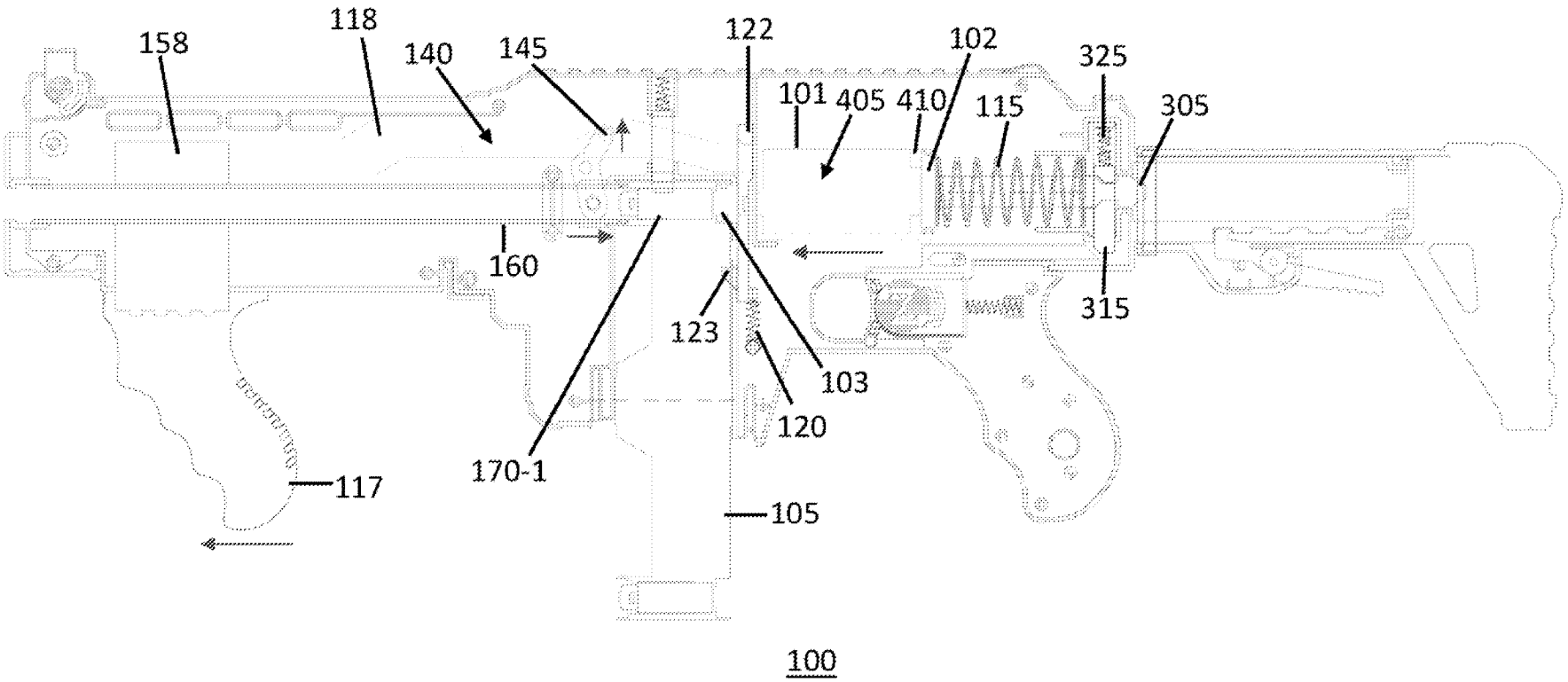
FIG. 4 is a schematic partial cross-sectional side view of the toy projectile launcher of FIG. 3A with the cocking slide or handle being returned to a forward firing position according to an exemplary embodiment of the present disclosure.

Referring now to FIG. 4, with the notch/recess 330 of rod portion 305 engaged with plate 315 via the downward bias of spring 325, the user can push cocking slide 117 forward in a second priming step—again, in a similar fashion to a pump action rifle—see forward arrow adjacent cocking slide 117 in FIG. 4. Consequently, barrel 101 is pulled forward (see forward arrow adjacent barrel 101) towards the front of launcher 100 by reciprocating frame 118 while rod portion 305 and plunger element 102 are held in place by plate 315. As shown in FIG. 4, compression spring 115 remains fully compressed by the return of cocking slide 117 to its original forward position. Accordingly, plunger element 102 forms an air chamber 405 within barrel 101 whereby air is drawn in through a front nozzle 103 of barrel 101. In accordance with an exemplary embodiment of the present disclosure, plunger element 102 incorporates an additional resilient ring 410 on a front surface thereof to further improve the seal for air chamber 405 and to provide cushioning between the front surface of plunger element 102 and the rear internal surface of barrel 101. Nozzle 103 may be of a substantially smaller diameter than that of the air chamber 405 so that a forward push by plunger 102 would expel the air through nozzle 103 at a higher pressure.

As further shown in FIG. 4, as the cocking slide 117 is moved forward in the direction shown by the forward arrow, the next dart 170-1 is in position in front of nozzle 103, now inserted back into rear opening 230, and is aligned with launch barrel 160, now also inserted back into front opening 235, in a firing position. Nozzle 103 is reinserted into rear opening 230 by reciprocating frame 118 pulling barrel 101 back forward into the forward position, as illustrated in FIG. 4. Correspondingly, pin 145 is slid and moved back upward along the rear section 140*a* (see FIG. 3B) of track 140 (see upward arrow adjacent pin 145 in FIG. 4), which, in turn, rotates lever 150 back around pivot point 155 in a clockwise direction in the configuration shown in the figures. As a result, the rotation of lever 150 pulls tube holder 165 backward and thereby moves launch barrel 160 backward (see backward arrow adjacent tube holder 165 and launch barrel 160 in FIG. 4). According to an exemplary embodiment of the present disclosure, launch barrel 160 has an internal diameter that provides minimal clearance for darts 170 to allow for substantially airtight propulsion from launch barrel 160 upon release of the pressurized air from air chamber 405.

As illustrated in FIGS. 1, 3B, and 4, launch barrel 160 incorporates an outer O-ring 345 on its rear portion that is of a slightly smaller external diameter for fittingly inserting into front opening 235 of dart holder 205, which is holding the next dart 170-1 for firing. Correspondingly, rear opening 230 of dart holder 205, which is holding the next dart 170-1, has a slightly larger internal diameter for receiving front nozzle 103 of barrel 101, thereby, again, providing for a substantially airtight connection from air chamber 405 to the rear surface of dart 170-1 in the launch position in dart holder 205 for launching through launch barrel 160. According to an exemplary embodiment of the present disclosure, nozzle 103 also incorporates an O-ring 303 (see FIG. 3A) around its outer circumference to form a seal around the internal circumference of rear opening 230 of dart holder 205. Advantageously, airtight seals are formed from air chamber 405 though dart holder 205 to launch barrel 160 to further improve the airtight connection.

Additionally, with reciprocating frame 118 being returned to the forward position, block 122, along with hook element 123, are returned to their lowered positions by extension spring 120 and hook element 123 is, thus, aligned to engage a next notch on drum 205.

Figure 5:
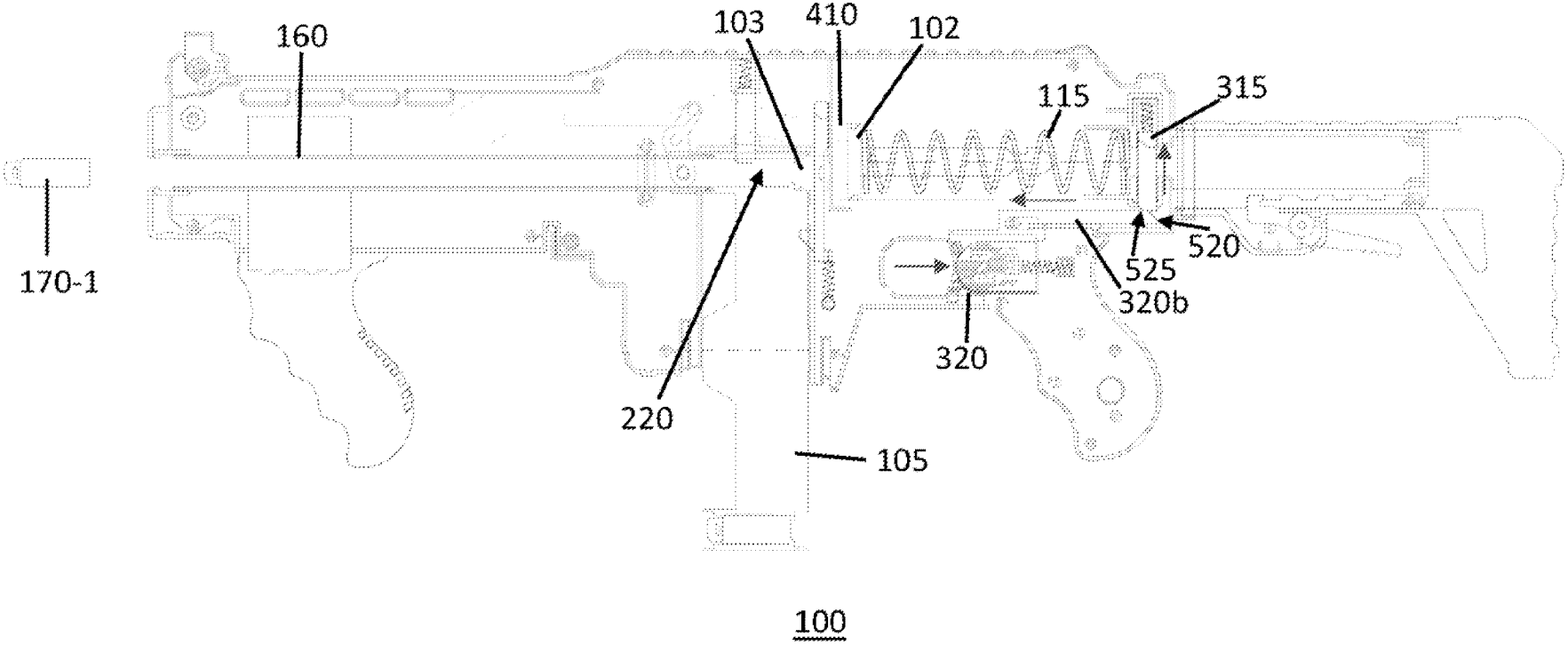
FIG. 5 is a schematic partial cross-sectional side view of the toy projectile launcher of FIG. 4 after a trigger pull illustrating the launch of a foam dart according to an exemplary embodiment of the present disclosure.

Next, a trigger pull and launch action will be described. FIG. 5 illustrates the interface between the rear portion of trigger assembly 320 and locking plate 315. As illustrated in FIG. 5, trigger assembly 320 includes an inclined surface 520 and an upper surface 525—which collectively form a top camming surface of trigger assembly 320 so that, when trigger assembly 320 is pulled backward by the user, locking plate 315 is caused to move upward from inclined surface 520 to the upper surface 525 against spring 325. In embodiments, trigger assembly 320 may be biased forward in a default position by a spring 530, or the like, such that plate 315 returns to contacting the inclined surface 520 when trigger 320 is in the forward, default, non-firing position. Again, a user can pull trigger assembly 320 backward (see backward arrow adjacent trigger 320 in FIG. 5) and, as trigger assembly 320 is slid backwards (see the extension element 320*b* of trigger assembly 320), the rear portion with surfaces 520 and 525, i.e., the top camming surface, is pushed backwards and, accordingly, slides plate 315 upward towards upper surface 525. Consequently, as plate 315 is pushed upward by the top camming surface (surfaces 520 and 525) of trigger assembly 320 (see upward arrow adjacent plate 315 in FIG. 5), the engagement between plate 315 and notch/recess 330 of rod portion 305 is released as aperture 310 is moved upward to a position that clears notch/recess 330. Thus, as illustrated in FIG. 5, spring 115 is released from its fully compressed state thereby driving plunger element 102 forcefully forward (see forward arrow adjacent compression spring 115 in FIG. 5) until cushioning ring 410 abuts the rear internal surface of barrel 101 to thereby expel the collected air from air chamber 405 through nozzle 103 to launch dart 107-1 through launch barrel 160. Advantageously, with the airtight seals provided from nozzle 103, through dart holder 205, to launch barrel 160, the launch force and velocity for dart 107-1 is improved. Correspondingly, trigger assembly 320 is returned to the forward default position and plate 315 is returned to its lowered position by compression spring 325. According to an exemplary embodiment of the present disclosure, cocking slide 117 may be pulled backward again to the position shown in FIG. 3A to prime a next dart 170 in drum 105 into the firing position.

Alternatively, trigger assembly 320 may merely incorporate an inclined surface 520 at its rear portion to serve as a camming surface (without requiring plate 315 to reach upper surface 525 shown in FIG. 5) so that as inclined surface 520 is pushed backwards, it slides plate 315 upward until the engagement between plate 315 and notch/recess 330 of rod portion 305 is released as aperture 310 is moved upward to a position that clears notch/recess 330. Additionally, spring 325 described above may be embodied by a spring-loaded arm or a leaf spring (not shown) in an exemplary embodiment of the present disclosure.

Figure 6A:
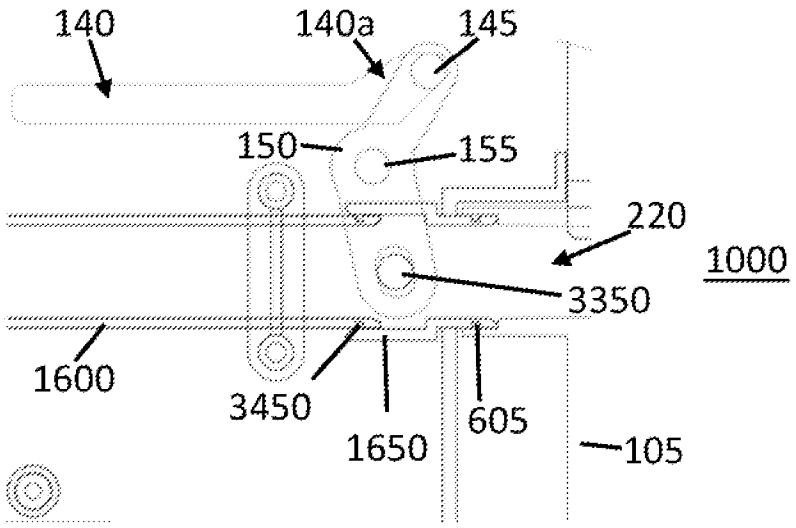
FIGS. 6A and 6B are cutaway closeup cross-sectional side views illustrating details of a launch barrel sealing extender assembly in a toy launcher according to another exemplary embodiment of the present disclosure.
Figure 6B:
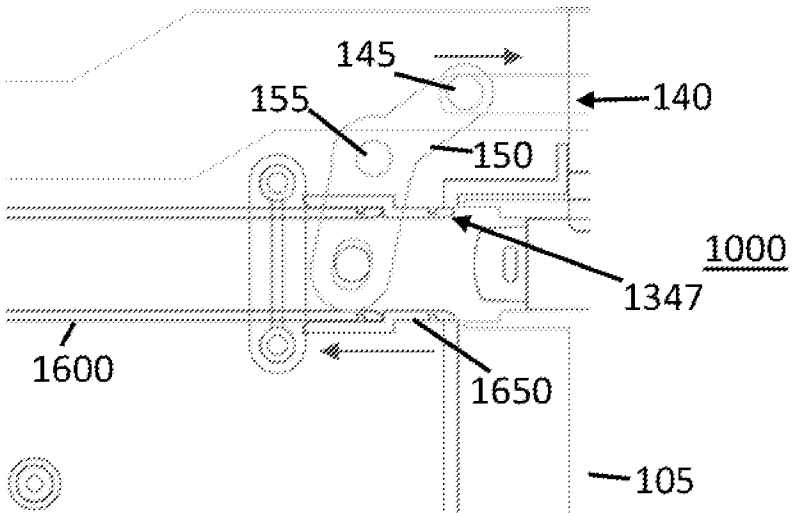

Next, an alternative exemplary embodiment of a launch barrel sealing extender assembly will be described with reference to FIGS. 6A and 6B. In such an alternative embodiment, a launcher 1000 incorporates a fixed launch barrel 1600 having the same internal and external diameters in place of the movable launch barrel 160 described above. Instead of a tube holder 165 for holding and moving launch barrel 160, launcher 1000 according to this alternative embodiment incorporates a slidable extender assembly 1650 having a front opening with an internal circumference that fits over a rear end of launch barrel 1600 and having a rear portion with the same dimensions as launch barrel 160/1600 that is, therefore, insertable into front opening 235 of dart holder 205 in a manner similar to launch barrel 160 described above. FIGS. 6A and 6B are cutaway closeup side views illustrating details of extender assembly 1650 in positions that correspond to those of launch barrel 160 illustrated in FIGS. 3B and 3C, respectively. Launcher 1000 otherwise incorporates like elements (not shown) as those of launcher 100 shown in FIGS. 1-5 and duplicative detailed descriptions of such elements and their operations will not be repeated.

FIG. 6A is a closeup cross-sectional side view illustrating details of slidable extender assembly 1650 in the resting position corresponding to the resting position of barrel 160 shown in FIG. 3B. Specifically, with cocking slide 117 in the forward position shown in FIG. 1, pin 145 of lever 150 abuts a rear end of track 140 in reciprocating frame 118. In correspondence with FIG. 3B, track 140 includes an upward sloping section 140*a* towards its rear end so that pin 145 is in an upward position when cocking slide 117—and, correspondingly, reciprocating frame 118—is in the forward position. Thus, extender assembly 1650 is in a rearward position and is inserted into front opening 235 of one of the dart holders 205 in drum 105. In this position, O-ring 3450 on an outer rear portion of fixed barrel 1600 and an O-ring 605 on an outer rear portion of extender assembly 1650 collectively provide an airtight seal from dart holder 205 through to launch barrel 1600. Thus, in the forward resting/firing position shown in FIG. 6A, a dart 170-*n* (not shown) that is primed for firing in the manner described above can be launched through extender assembly 1650 and launch barrel 1600 with a comparable airtight connection as between dart holder 205 and launch barrel 160 described above. Additionally, according to an exemplary embodiment, the rear trailing interior edge of extender assembly 1650 may incorporate a rounded taper 1347 around the interior circumference of extender assembly 1650, as illustrated in FIG. 6A, to provide additional clearance for launching darts 170 and to avoid possible obstructions to such launchings by a cornered edge at the joint between main section 220 and extender assembly 1650 in the launch configuration (i.e., with extender assembly 1650 in the rearward position, as illustrated in FIG. 6A).

Referring to FIG. 6B, as a user pulls back on cocking slide 117, pin 145 is moved downward along the rear section 140*a* of track 140, which, in turn, rotates lever 150 around pivot point 155 in a counterclockwise direction in the configuration shown in the figures. As a result, the rotation of lever 150 pulls extender assembly 1650 forward (see forward arrow adjacent extender assembly 1650 in FIG. 6B). In embodiments, lever 150 may be rotated further by the front end of track 140 pushing pin 145 rearward with the rearward movement of reciprocating frame 118 (see rearward arrow adjacent pin 145 in FIG. 6B). Accordingly, the rear end of extender assembly 1650 is withdrawn from front opening 235 (see FIG. 2B) of one of the dart holders 205 in drum 105, thus clearing the way on the front end for drum 105 to rotate and, as described above, advance a next dart 170-1 into a firing position. In embodiments, lever 150 may be coupled to extender assembly 1650 via one or more rotatable joints 3350 on either or both sides of extender assembly 1650. Once a next dart 170-1 is primed into a firing position, extender assembly 1650 may be returned to the position illustrated in FIG. 6A by a return of the cocking slide 117 to the forward position and, thereafter in like manner as described above, the next dart 170-1 may be launched by a pull on trigger 320.

Although the exemplary embodiment is described in the context of a foam bullet/dart launcher that utilizes shortened foam bullets/darts, it is to be understood that the two-step priming/loading and firing action according to the present disclosure could be applied to a toy projectile launcher of other types of projectiles (e.g. a ball or the like) or a fluid launcher whereby the fluid from a reservoir in the handle is driven by a plunger. In such environment the two-step priming/pumping action of the present disclosure enables a handheld high-velocity fluid burst launcher.

While particular embodiments of the present disclosure have been shown and described in detail, it would be obvious to those skilled in the art that various modifications and improvements thereon may be made without departing from the spirit and scope of the disclosure. It is therefore intended to cover all such modifications and improvements that are within the scope of this disclosure.

What is claimed is:

1. A toy projectile launcher, comprising:

a plurality of projectile holders, each projectile holder adapted to hold a projectile;

a cocking slide that is adapted to be moved forward and backward;

a launch barrel;

a housing;

an air piston assembly disposed within the housing, the air piston assembly including an air piston barrel having an air nozzle disposed on a front portion thereof, a plunger element, and a compression spring, wherein the launch barrel and the air piston assembly are each coupled to the cocking slide, wherein, when the cocking slide is moved backward from a forward position to a backward position:

the air piston barrel moves backward and pushes the plunger element to compress the compression spring against a rear wall of the housing; and the launch barrel is moved forward away from a front portion of a first projectile holder in the plurality of projectile holders, and wherein, when the cocking slide is moved forward from the backward position to the forward position:

the air nozzle moves forward to form an airtight seal between the air piston barrel and a rear portion of the first projectile holder; and the launch barrel is moved backward toward the front portion of the first projectile holder to form an airtight seal between the front portion of the first projectile holder and a rear portion of the launch barrel.

2. The toy projectile launcher of claim 1, wherein the air piston assembly is coupled to the cocking slide via a coupling between the air piston barrel and the cocking slide.

3. The toy projectile launcher of claim 1, wherein a tube holder is fixed to and surrounds at least a portion of the launch barrel, and wherein the launch barrel is moved when a reciprocating frame coupled to the cocking slide slides against a lever coupled to the tube holder.

4. The toy projectile launcher of claim 3, wherein the plunger element and the air piston barrel form an internal air chamber when the cocking slide is moved from the backward position to the forward position.

5. The toy projectile launcher of claim 4, further comprising a latching assembly coupled between the plunger element and a trigger assembly, wherein the trigger assembly is adapted to be pulled backward by a user of the toy projectile launcher.

6. The toy projectile launcher of claim 5, wherein, when the trigger assembly is pulled backward, the coupling of the latching assembly between the plunger element and trigger assembly is released, and the plunger element is pushed forward by the compression spring to expel air from the internal air chamber through the air nozzle disposed on the front portion of the air piston barrel behind the loaded projectile in the firing position.

7. The toy projectile launcher of claim 6, wherein, when the loaded projectile is in the firing position, the air nozzle disposed on the front portion of the air piston barrel is immediately adjacent to the loaded projectile.

8. The toy projectile launcher of claim 1, wherein the plunger element forms an airtight seal with an internal surface of the air piston barrel.

9. The toy projectile launcher of claim 1, wherein the first projectile holder a front opening, a main central portion, a rear end ring, and a rear opening, wherein the rear opening has a larger cross-sectional diameter than the main portion for accommodating the air nozzle, the rear opening and air nozzle forming an airtight seal from the air piston barrel to a rear end of a projectile loaded into the first projectile holder.

10. The toy projectile launcher of claim 9, wherein the air nozzle has an outer circumference having a first O-ring incorporated thereon, and wherein the first O-ring forms an airtight seal with an internal circumference of the rear opening of the first projectile holder.

11. The toy projectile launcher of claim 9, wherein the front opening of the first projectile holder has a larger cross-sectional diameter than the main central portion for accommodating the launch barrel, the front opening and launch barrel forming an airtight seal from the main central portion to the launch barrel.

12. The toy projectile launcher of claim 11, wherein a rear end of the launch barrel has a second O-ring incorporated thereon, and wherein the second O-ring and front opening of the projectile holder forms an airtight seal between the launch barrel and the main central portion of the projectile holder.

13. The toy projectile launcher of claim 1, wherein the plurality of projectile holders are contained within a projectile drum.

14. The toy projectile launcher of claim 13, wherein the projectile drum includes a projectile advancement mechanism for advancing a next projectile loaded into one of the plurality of projectile holders contained in the projectile drum into a firing position in front of the air piston barrel.

15. The toy projectile launcher of claim 1, wherein the projectiles are foam darts.

16. A toy projectile launcher, comprising:

a plurality of projectile holders, each projectile holder adapted to hold one projectile;

a cocking slide that is adapted to be moved forward and backward;

a housing;

a launch barrel fixed to the housing;

a slidable launch barrel sealing extender assembly fitted over a rear end of the fixed launch barrel; and an air piston assembly disposed within the housing, the air piston assembly including an air piston barrel having an air nozzle disposed on a front portion thereof, a plunger element, and a compression spring, wherein the slidable launch barrel sealing extender assembly and the air piston assembly are each coupled to the cocking slide, wherein, when the cocking slide is moved backward from a forward position to a backward position:

the air piston barrel moves backward and pushes the plunger element to compress the compression spring against a rear wall of the housing; and the slidable launch barrel sealing extender assembly is moved forward away from a front portion of a first projectile holder in the plurality of projectile holders, and wherein, when the cocking slide is moved forward from the backward position to the forward position:

the air nozzle moves forward to form an airtight seal between the air piston barrel and a rear portion of the first projectile holder; and the slidable launch barrel sealing extender assembly is moved rearward towards the first projectile holder to form an airtight connection between the front portion of the first projectile holder and the rear portion of the fixed launch barrel.

17. The toy projectile launcher of claim 16, wherein the air piston assembly is coupled to the cocking slide via a coupling between the air piston barrel and the cocking slide.

18. The toy projectile launcher of claim 16, wherein the plunger element and the air piston barrel form an internal air chamber when the cocking slide is moved from the backward position to the forward position.

19. The toy projectile launcher of claim 18, further comprising a latching assembly coupled between the plunger element and a trigger assembly, wherein the trigger assembly is adapted to be pulled backward by a user of the toy projectile launcher.

20. The toy projectile launcher of claim 19, wherein, when the trigger assembly is pulled backward, the coupling of the latching assembly between the plunger element and trigger assembly is released, and the plunger element is pushed forward by the compression spring to expel air from the internal air chamber through the air nozzle disposed on the front portion of the air piston barrel behind the loaded projectile in the firing position.

21. The toy projectile launcher of claim 20, wherein, when the loaded projectile is in the firing position, the air nozzle disposed on the front portion of the air piston barrel is immediately adjacent to the loaded projectile.

22. The toy projectile launcher of claim 16, wherein the plunger element forms an airtight seal with an internal surface of the air piston barrel.

23. The toy projectile launcher of claim 16, wherein the plurality of projectile holders are contained in a projectile storage drum.

24. The toy projectile launcher of claim 23, wherein the projectile drum includes a projectile advancement mechanism for advancing a next projectile loaded into one of the plurality of projectile holders contained in the projectile drum into a firing position in front of the air piston barrel.

25. The toy projectile launcher of claim 23, wherein the first projectile holder contained in the projectile drum has a front opening, a main central portion, a rear end ring, and a rear opening, wherein the rear opening has a larger cross-sectional diameter than the main portion for accommodating the air nozzle, the rear opening and air nozzle forming an air-tight seal from the air piston barrel to a rear end of a projectile loaded into the first projectile holder.

26. The toy projectile launcher of claim 25, wherein the air nozzle has an outer circumference having a first O-ring incorporated thereon, and wherein the first O-ring forms an airtight seal with an internal circumference of the rear opening of the first projectile holder.

27. The toy projectile launcher of claim 25, wherein the front opening of the first projectile holder is adapted to accommodate the slidable launch barrel sealing extender assembly, the front opening and slidable launch barrel sealing extender assembly forming an airtight seal from the main central portion to the fixed launch barrel.

28. The toy projectile launcher of claim 26, wherein a rear end of the fixed launch barrel has a second O-ring incorporated thereon, and wherein a rear portion of the slidable launch barrel sealing extender assembly has a third O-ring incorporated thereon, the second O-ring and the third O-ring forming an airtight seal between the fixed launch barrel and the first projectile holder.

29. The toy projectile launcher of claim 16, wherein the projectiles are foam darts.

* * * * *